US005213357A

United States Patent [19]

Gorza et al.

[11] Patent Number: 5,213,357

[45] Date of Patent: May 25, 1993

[54] SKI BINDING WITH ELASTIC RECOVERY MEANS FOR FREE SKI FLEXING

[75] Inventors: Roberto Gorza, Feltre; Giorgio Baggio, San Martino Di Lupari; Mirco Battistella, Spresiano, all of Italy

[73] Assignee: Nordica S.p.A., Montebelluna, Italy

[21] Appl. No.: 883,989

[22] Filed: May 18, 1992

[30] Foreign Application Priority Data

May 23, 1991 [IT] Italy ..... 1419 A/91
Jun. 4, 1991 [IT] Italy ..... 1522 A/91

[51] Int. Cl.[5] ..... A63C 9/08

[52] U.S. Cl. ..... 280/607; 280/616; 280/633

[58] Field of Search ..... 280/623, 613, 617, 618, 280/616, 607, 634, 636, 602, 633

[56] References Cited

FOREIGN PATENT DOCUMENTS 0424846 10/1990 European Pat. Off. .
0441251 2/1991 European Pat. Off. .
2417313 2/1979 France .
2654636 11/1989 France .
8203182 3/1982 PCT Int'l Appl. .

*Primary Examiner*—Richard M. Camby
*Attorney, Agent, or Firm*—Guido Modiano; Albert Josif

[57] ABSTRACT

A ski binding including a toe unit which is fixed to the ski and is provided with an adjustable spring acting on the toe unit safety release member. The binding also has a plate which extends longitudinally along the ski and is associated, at one end, with the toe unit safety release member and, at its other end, with a sliding body which supports the jaw. A rear spring is interposed between the sliding body and the plate in order to keep constant the center distance set between the toe unit and the heel unit, when the ski flexes.

3 Claims, 2 Drawing Sheets

SKI BINDING WITH ELASTIC RECOVERY MEANS FOR FREE SKI FLEXING

BACKGROUND OF THE INVENTION

The present invention relates to a ski binding with elastic recovery means for free ski flexing.

As is known, during skiing the ski undergoes flexing, due to the central load constituted by the weight of the skier, as a consequence of the presence of holes or in any case of other discontinuities in the skiing surface.

Currently, so-called elastic recovery means are used in order to keep constant the center distance between the toe unit and the heel unit, which is substantially determined by the length of the sole; said elastic recovery means allow and elastically contrast the backward movement of the heel unit when the ski flexes.

With known solutions, both the toe unit and the heel unit discharge tensions onto the ski; said tensions are produced by the mutual thrust of the toe unit and of the heel unit on the sole and unavoidably hinder the free flexing of said ski.

Solutions which have attempted to eliminate this disadvantage have generally lead to the production of ski bindings having a considerably complicated structure and having the additional disadvantage of significantly altering, during ski flexing, the safety release force setting values which are normally preset.

SUMMARY OF THE INVENTION

The aim of the invention is indeed to eliminate the disadvantages described above by providing a ski binding with elastic recovery means for free ski flexing which prevents the heel unit from creating stresses on the ski both when the boot is inserted and when it is removed.

Within the scope of the above aim, a particular object of the invention is to provide a ski binding wherein it is possible to precisely adjust the position of the heel unit in order to adapt to various boot sizes.

Another object of the present invention is to provide a ski binding which, by virtue of its peculiar constructive characteristics, is capable of giving the greatest assurances of reliability and safety in use.

No least object of the present invention is to provide a ski binding which can be easily obtained starting from commonly commercially available elements and materials and is furthermore competitive from a merely economical point of view.

This aim, these objects and others which will become apparent hereinafter are achieved by a ski binding with elastic recovery means for free ski flexing, characterized in that it comprises a toe unit which is fixed to the ski and is provided with adjustable elastic means which act on the toe unit safety release means, a plate which extends longitudinally along the ski and is associated, at one end, with said toe unit safety release means and, at its other end, with a sliding body which supports the heel unit jaw, elastic recovery means being interposed between said sliding body and said plate in order to keep constant, when the ski flexes, the center distance set between said toe unit and said heel unit.

BRIEF DESCRIPTION OF THE DRAWINGS

Further characteristics and advantages will become apparent from the description of a preferred but not exclusive embodiment of a ski binding with elastic recovery means for free ski flexing, illustrated only by way of non-limitative example in the accompanying drawings, wherein.

DESCRIPTION OF THE PREFERRED EMBODIMENTS

Figure 1:
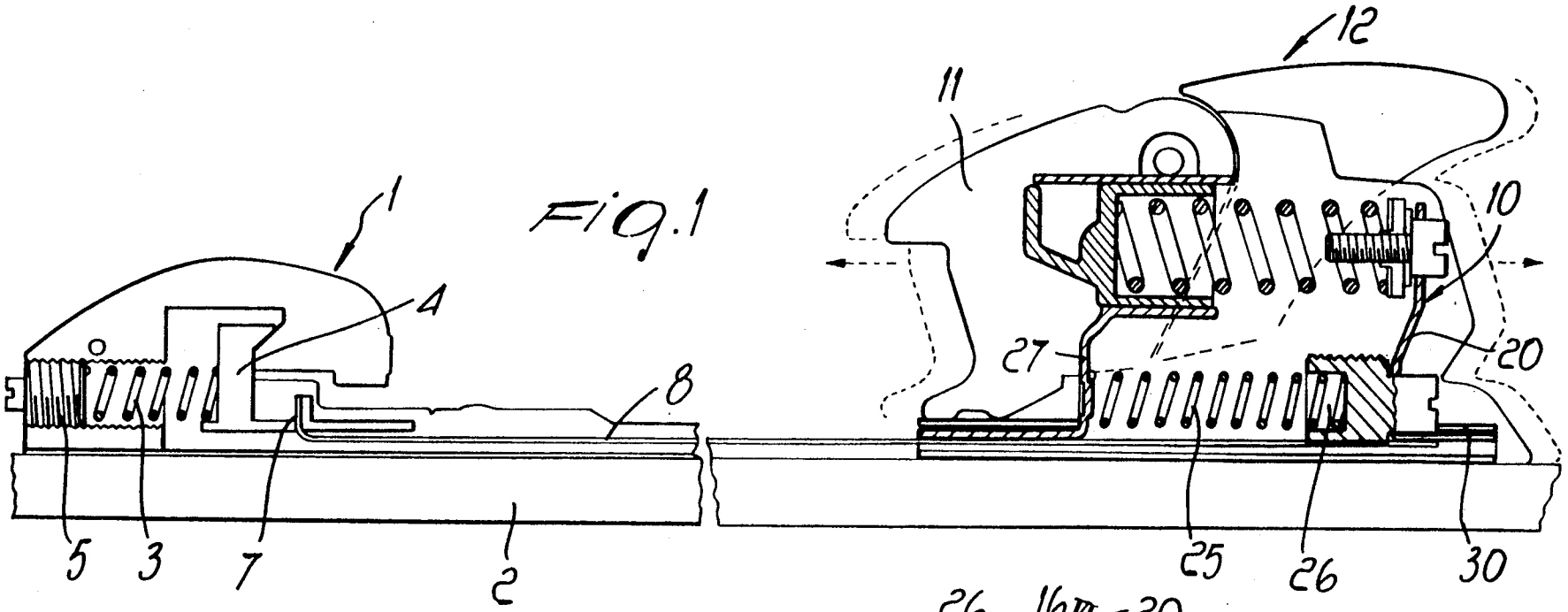
FIG. 1 is a schematic view of the ski binding according to the invention.
Figure 2:
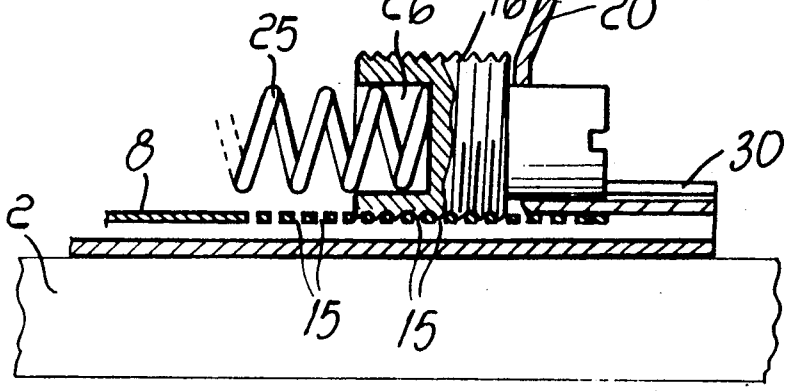
FIG. 2 is a schematic perspective view of the means which connect the sliding body of the heel unit and the end of the plate.

With reference to FIGS. 1–2, the ski binding with elastic recovery means for free ski flexing, according to the invention, comprises a toe unit 1 which is fixed to a ski 2 in a per se known manner.

Adjustable elastic means are provided inside the toe unit 1 and are constituted by a front spring 3 which acts on a sliding carriage 4 which in practice constitutes the means for the safety release of the toe unit.

A threaded dowel 5 acts on the front spring 3, can be accessed from the front part of the toe unit and allows to adjust the setting of the front spring and accordingly the setting of the safety release force.

The front end 7 of a plate 8 is associated with the toe unit 1 and more precisely with the carriage 4, extends longitudinally along the ski and is arranged below the sole of the boot.

At its rear end, said plate 8 is connected to a sliding body, generally designated by the reference numeral 10, which supports the jaw 11 of the heel unit 12.

More precisely, the plate 8 is provided, at its rear end, with notches 15 which substantially define a female thread with which a worm screw 16 meshes; said worm screw abuts against the rear wall 20 of the movable body.

The position of the sliding body is changed by acting on the screw 16; said sliding body can move forward or backward so as to obtain the required center distance between the heel unit 12 and the toe unit 1 according to the size of the ski boot.

The sliding body 10 is slidingly guided in a direction which is longitudinal with respect to the extension of the ski by means of heel unit guides, designated by 30, which are fixed to the ski.

Elastic recovery means are furthermore provided and are constituted by a rear spring 25 which acts between an internal recess 26 defined on the front part of the worm screw 16 and a front wall 27 of the sliding body 10.

The rear spring 25 has the function of allowing the elastically contrasted backward movement of the heel unit 12 when the ski flexes; said spring 25 furthermore cooperates with the spring 3 in order to define the setting load of the toe unit, thus allowing to use a smaller spring for the toe unit, with a reduction in bulk.

It should be noted that with the above described arrangement the plate 8 is under tension, with the load of the elastic recovery spring constituted by the rear spring 25, only when the boot is inserted, and even in this case the entire load is discharged onto the toe unit anchoring screws.

When the boot is not inserted, the plate is not under tension.

Furthermore, when the boot is inserted, the ski is stressed exclusively in one point, which is the toe unit anchoring point, whereas tensions on the ski produced by the heel unit do not occur, since the heel unit is in practice connected by means of the sliding body which is associated with the plate and accordingly does not discharge tensions onto the ski.

In this manner, in case of flexing the ski is not subjected to stresses and the free flexing of the ski, which is considered optimum for correct skiing, can thus occur.

With this arrangement, the setting of the toe unit release means is entrusted to the front spring 4, which is provided directly in the toe unit and can be set, by means of the threaded dowel 5, according to the different requirements of the user.

In case of ski flexing, the toe unit 12 can move backward, keeping the center distance of the sole constant, without thereby discharging additional tensions onto the ski, since the sliding body, which is connected to the plate, can move freely with respect to the ski.

From what has been described above it can thus be seen that the invention achieves the intended aim and objects, and in particular the fact is stressed that the described arrangement considerably simplifies all structural executions and furthermore allows to have an easy elastic recovery which is entrusted exclusively to the rear spring 25.

The ski binding according to the invention thus conceived is susceptible to numerous modifications and variations, all of which are within the scope of the inventive concept.

Figure 3:
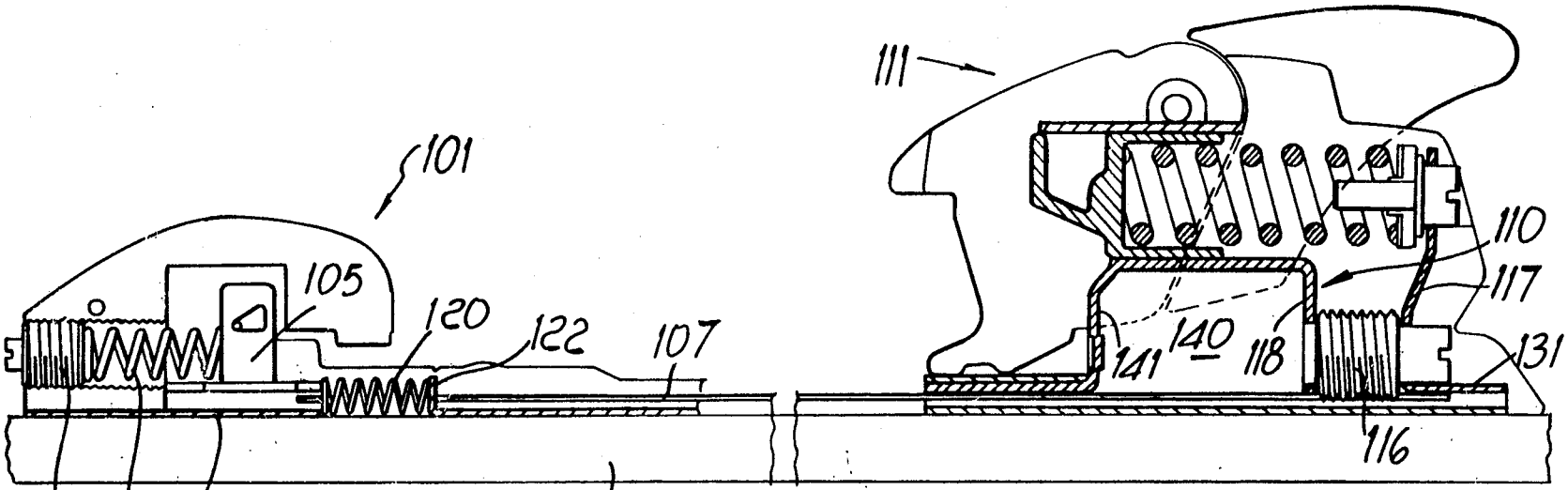
FIG. 3 is a partially sectional side view of a ski binding according to a further aspect of the invention.
Figure 4:
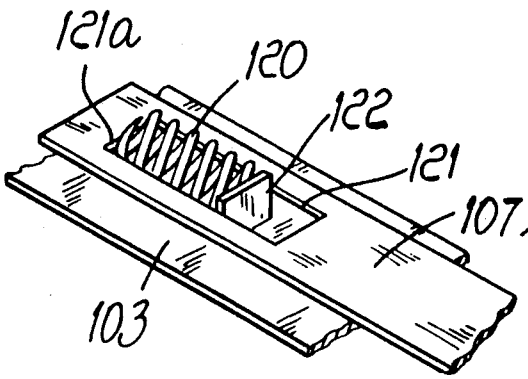
FIG. 4 is an isometric detail view of the plate of the binding of FIG. 3.
Figure 5:
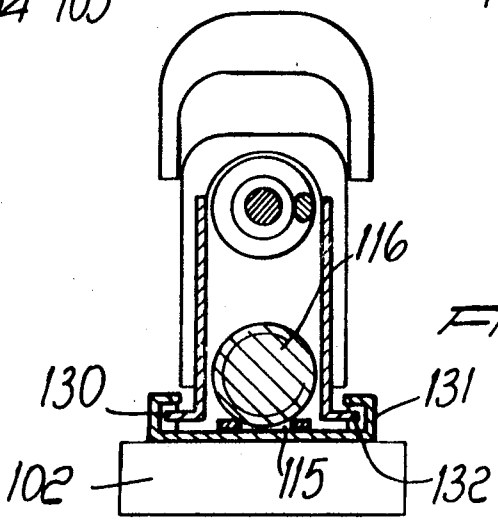
FIG. 5 is a sectional front view of the binding of FIG. 3.

FIGS. 3–5, for example, show a ski binding with elastic recovery means for free ski flexing, according to a further aspect of the invention, comprising a toe unit 101 which is connected to the ski 102 by means of a supporting base 103 which is fixed to the ski.

Adjustable elastic means are provided inside the toe unit 101 and are constituted by a front spring 104 which acts on a sliding carriage 105 which in practice constitutes the toe unit safety release means.

A threaded dowel 106 acts on the front spring, can be accessed from the front part of the toe unit and allows to adjust the setting of the front spring and accordingly the setting of the toe unit safety release force both in case of lateral release and in case of upward release.

The front end of a plate 107 is associated with the supporting base 103 of the toe unit 101; said plate extends longitudinally along the ski and can be arranged below the sole of the boot; the sliding body 110 of the heel unit 111 is furthermore associated with the rear end of the plate 107.

More in detail, the plate 107 is associated with the base 103, at its front end, by means of the interposition of elastic recovery means constituted by an elastic recovery spring 120 which is accommodated in a slot 121 defined on the plate and acts between the end **121*a* of the slot and an abutment tooth 122 which is defined on the base 103** of the toe unit and is accommodated within said slot.

The plate is furthermore provided, at its rear end, with a plurality of notches, designated by 115, which in practice define a female thread in which a worm screw 116 engages; said worm screw is rotatably supported between the rear wall 117 of the sliding body 110 and an internal, or median wall 118 of said sliding body.

By acting on the screw 116, the position of the sliding body is changed with respect to the plate, since the sliding body can move forward or backward, so as to define the preset center distance between the heel unit 111 and the toe unit 101, according to the size of the boot.

The sliding body 110 is slidingly guided longitudinally with respect to the extension of the ski by means of guides 130 which are defined by the base 131 of the heel unit and slidingly accommodate lateral wings 132 of the sliding body.

With this arrangement, an empty compartment, designated by 140, is defined in the sliding body 110 of the heel unit and is arranged between the wall 118 and the front wall 141; it is therefore possible to insert other mechanisms in the heel unit, such as for example a further spring for opening the heel unit jaw or possibly a built-in brake which does not require a pedal to close it since the pedal of the heel unit jaw might in fact be used.

With the described arrangement, the elastic recovery spring 120 has the function of allowing the elastically contrasted backward movement of the heel unit 111 in case of ski flexing, and said spring, by virtue of the fact that the plate is disengaged from the heel unit, furthermore does not affect the setting values of the spring 104 which acts on the toe unit safety release means.

With the described arrangement, the plate 107 is under tension with the load of the elastic recovery spring only when the boot is inserted and, even in this case, all the load which acts on the ski is discharged onto the screws which anchor the base 103 of the toe unit to the ski.

If the boot is not inserted in the binding, the plate is not under tension, since no elastic forces act thereon.

When the boot is inserted, the ski is stressed exclusively in one point, which is the toe unit base anchoring point, whereas tensions on the ski caused by the heel unit do not occur, since the heel unit is in practice connected by means of the sliding body which is associated with the plate and accordingly does not discharge tensions onto the ski.

In this manner, in case of flexing, the ski is not subjected to stress and accordingly the free flexing of the ski, which is considered optimum for correct skiing, can occur.

With this type of binding, the plate can move longitudinally in both directions with respect to the ski during boot insertion and removal, during ski flexing and as during heel unit or toe unit release, since in case of toe unit release the plate moves due to the approach of the heel unit to the toe unit produced by the elastic recovery spring.

The binding illustrated in FIGS. 3–5 has the advantage of allowing more space in the heel unit for arranging additional mechanisms.

All the details may furthermore be replaced with other technically equivalent elements.

In practice, the materials employed, as well as the contingent shapes and dimensions, may be any according to the requirements.

We claim:

1. A ski binding connectable to a ski top portion, comprising:

a front toe unit for releasably holding down a ski boot toe portion, said front toe unit comprising a spring-biased sliding carriage element;

a rear heel unit for releasably holding down a ski boot heel portion, said rear heel unit including: a sliding body; means for slidably connecting said sliding body to the ski top portion; and a spring-biased heel holding jaw which is pivotally supported by said sliding body;

means for connecting said ski binding to the ski top portion such that said front toe unit and said rear heel unit are mutually spaced apart, said means for connecting said ski binding to the ski top portion comprising a supporting base for the front toe unit, said supporting base being rigidly connectable to the ski top portion;

a sliding plate element having a first end and a second end, the first end of the sliding plate element being connected with said sliding body of said rear heel unit and thereby said sliding plate being slidable in unison with said sliding body, said sliding plate element extending from said rear heel unit to said front toe unit at which is arranged said second end of said sliding plate; and spring biasing means interposed between said second end of said sliding plate element and a portion of said supporting base of the front toe unit, thereby for biasing said sliding plate and said sliding body into a forward position with respect to said supporting base while allowing said sliding plate and said sliding body to slide rearwardly with respect to said supporting base.

2. A ski binding according to claim 1, wherein said sliding plate is provided with a slot (121) near said second end **(121*a*) thereof, said portion of said supporting base comprising an upwardly extending abutment tooth (122) which is arranged in said slot, said spring biasing means comprising a spring (120)** accommodated in said slot and interposed between said tooth and said second end of said sliding plate.

3. A ski binding according to claim 1, further comprising means (115,116) for adjustably connecting said first end of said sliding plate element to said sliding body of said rear heel unit.

* * * * *